United States Patent [19]

Davis

[11] Patent Number: 5,076,570

[45] Date of Patent: Dec. 31, 1991

[54] HYDRAULIC HAND EXERCISER

[75] Inventor: Link H. Davis, Hurst, Tex.

[73] Assignee: Link Enterprises, Inc., Arlington, Tex.

[21] Appl. No.: 661,919

[22] Filed: Feb. 26, 1991

Related U.S. Application Data

[63] Continuation-in-part of Ser. No. 315,913, Feb. 27, 1989, abandoned.

[51] Int. Cl.[5] ..... A63B 21/008

[52] U.S. Cl. ..... 272/68; 272/130

[58] Field of Search ..... 272/67, 68, 75, 130

[56] References Cited

U.S. PATENT DOCUMENTS

| | | | |
|---|---|---|---|
| 2,919,135 | 12/1959 | Marchionda | 272/130 X |
| 3,606,318 | 9/1971 | Gilstrad | 272/130 |
| 3,658,326 | 4/1972 | Fawick | 272/68 |
| 4,040,619 | 8/1977 | Landi | 272/68 |
| 4,146,222 | 3/1979 | Hribar | 272/130 x |
| 4,625,960 | 12/1986 | Gvoich et al. | 272/130 |
| 4,801,139 | 1/1989 | Vanhoutte et al. | 272/130 |

*Primary Examiner*—Robert Bahr

*Attorney, Agent, or Firm*—James E. Bradley

[57] ABSTRACT

A hand exercising apparatus uses two flexible hollow handles connected together by a conduit. The user alternately squeezes one handle then the other. Liquid contained in the handles and conduit will flow from one handle to the other. Valves located in each handle will restrict or increase the flow area to change the resistance.

14 Claims, 2 Drawing Sheets

HYDRAULIC HAND EXERCISER

CROSS REFERENCE TO RELATED APPLICATION

This application is a continuation-in-part of application Ser. No. 07/315,913, filed Feb. 27, 1989, "Hydraulic Hand Exerciser", now abandoned, inventor Link H. Davis.

BACKGROUND OF THE INVENTION

1. Field of the Invention

This invention relates generally to personal exercise equipment, and in particular to hydraulic load hand exercise devices.

2. Description of the Prior Art

Within about the past decade, society and in particular American society has become increasingly concerned with physical fitness. Body development by exercising has become significantly more prevalent than ever before. More and more people invest their leisure time in various forms of strenuous exercise to develop muscle toning for the various body parts. A variety of exercise devices have been developed to accommodate physical exercise routines.

Generally lacking in conventional exercise equipment has been an exerciser particularly suited for exercising hand, wrist and forearm muscles. While various devices are available that are or can be used for that purpose, their use has been limited in certain respects. Some have been known to produce undue soreness and pain about the knuckle or joints of the hands. Still others are characterized by limited functions that realize less than the desired toning which had been expected. Exemplifying the latter has been the hand squeezing of tennis balls that have proven to be of limited value for strengthening of hand muscles.

SUMMARY OF THE INVENTION

In the present invention, a hand-actuated exercise device has variably settable exercise loading imposed alternately between opposite hands for a strenuous concomitant exercise of both hands, wrists and forearms to any desired intensity sought by the user.

The hand exerciser includes a pair of tubular handles formed of a soft pliable material. The handles are interconnected in fluid communication with each other through a flexible tube. The unit is filled with a volume of relatively incompressible fluid. Squeezing one handle forces the fluid away and through the conduit into the other handle. Repetition of reversing fluid flow exercises the hand and arm muscles.

Provision is made in one handle for adjustably setting a valve for varying the resistance to fluid flow by which squeezing of the handle becomes increasingly more or less strenuous. In that manner, the muscle toning effectiveness of the unit can be readily accommodated to the specific requirements of an individual user and can be operated at will for so long as the individual wants to continue. Being portable, the unit can be conveniently transported to accompany the user when travelling, and can be taken daily between the office and home or wherever.

In the preferred embodiment, the means for adjusting the resistance to fluid flow is handled by a valve body and a valve stem. The valve body mounts to the flexible handle and has a valve sleeve. The valve sleeve extends inward toward the handle interior and has a sidewall containing a slot. The valve stem rotatably mounts inside the valve sleeve. The stem is tubular and has a stem slot in its sidewall. Rotating the valve stem will cause the slots to align with each other to a selected degree. The conduit mounts to the valve stem.

DETAILED DESCRIPTION OF THE INVENTION

Figure 1:
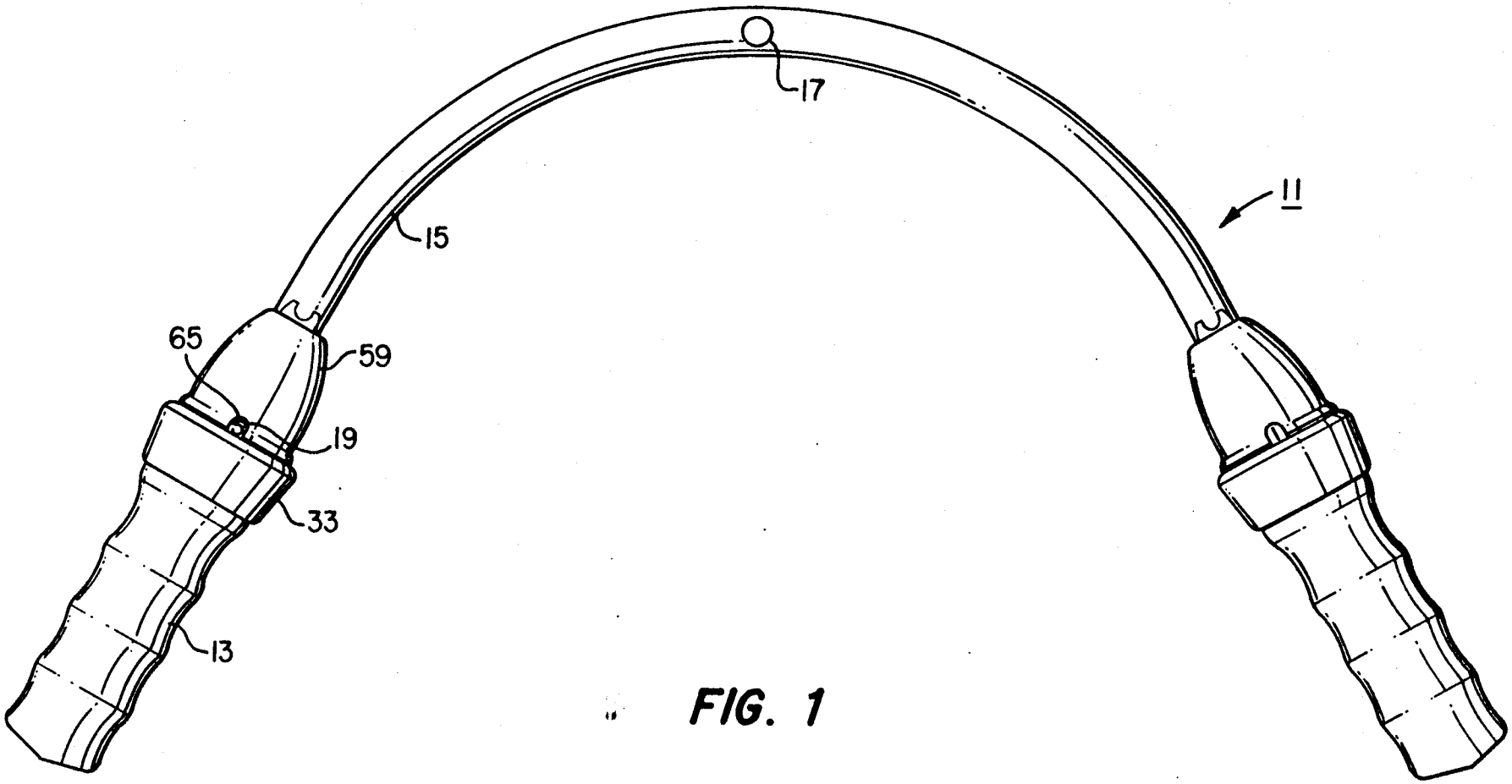
FIG. 1 is a side view of the exerciser apparatus of this invention.

Referring to FIG. 1, exercise apparatus 11 has two spaced apart handles 13. The handles 13 are interconnected by a transparent conduit 15. An incompressible fluid, normally a liquid, will be placed in the handles 13 and conduit 15. Squeezing one of the handles 13 will displace fluid through conduit 15 toward the other handle 13. A floating ball 17 is carried in the conduit 15 to show the movement of the fluid flow when one of the handles 13 is squeezed. Resistance to the squeezing action can be controlled by means that will be described herein. An indicia 19 indicates the degree of resistance set into each of the handles 13.

Figure 2:
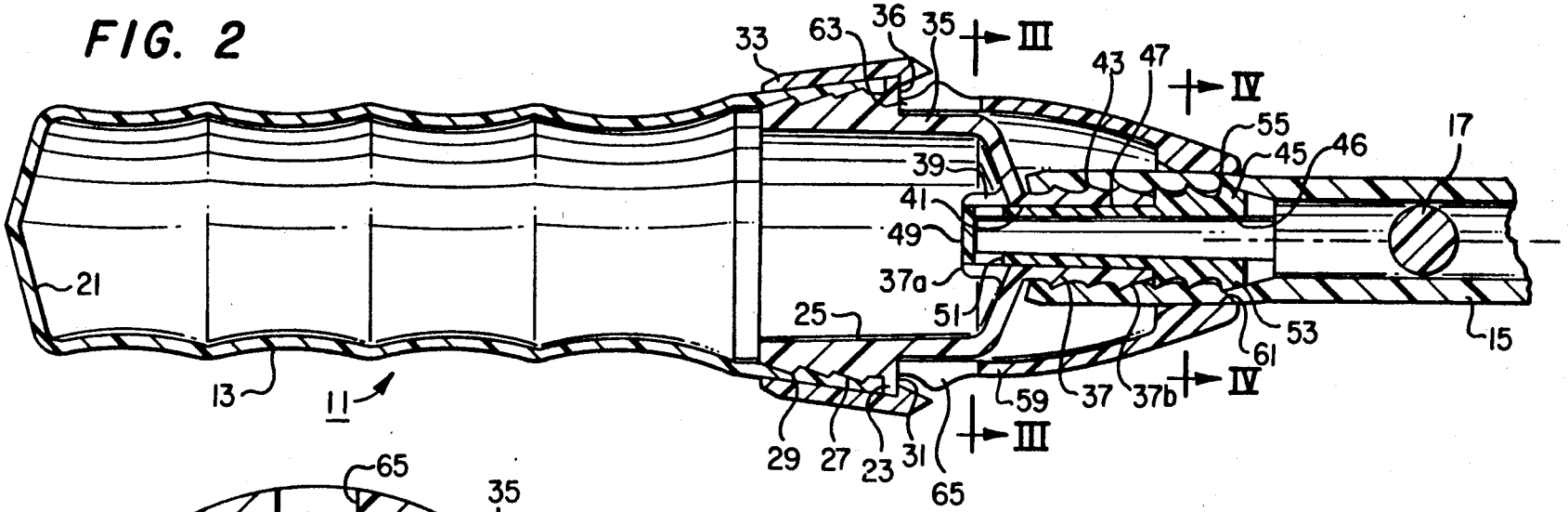
FIG. 2 is a sectional view of one of the handles for the exercising apparatus of FIG. 1.

Referring to FIG. 2, each handle 13 has a closed end 21 and an open end 23. A valve body 25 sealingly fits in the open end 23. Valve body 25 has a conical surface 27. The open end 23 of the handle 13 frictionally slides over the conical surface 27. Circumferential axially spaced apart ridges 29 extend around the conical surface 27 to assist in gripping the open end 23. A shoulder 31 serves as a stop for the open end 23.

A compression sleeve 33 will slide over the conical surface 27, sandwiching the open end 23 of the handle 13 between the compression sleeve 33 and the conical surface 27. This tightly and sealingly secures the handle 13 to the valve body 25. Valve body 25 is generally cup-shaped, with its interior and the interior of handle 13 forming a chamber.

Valve body 25 has an outer portion 35 that protrudes outward past the compression sleeve 33. Outer portion 35 begins at a shoulder 36 and has a cylindrical portion. Indicia 19 (FIG. 1) will be located on the cylindrical exterior of the valve body outer portion 35, near the shoulder 36.

A valve sleeve 37 is integrally formed with the valve body outer portion 35. Valve sleeve 37 is a tubular, necked portion of smaller outer diameter than the cylindrical exterior of valve body outer portion 35. Valve sleeve 37 has an inner portion **37*a* that protrudes a short distance inward from the valve body outer portion 35. Valve sleeve 37 has an outer portion 37*b*** that protrudes outward a greater distance.

Figure 3:
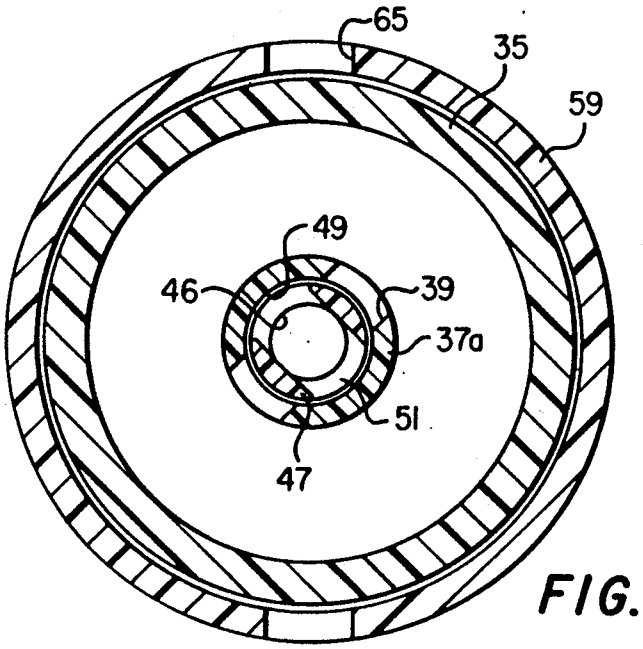
FIG. 3 is a cross sectional view of the handle of FIG. 2, taken along the line III—III, and showing the valve stem rotated from the view shown in FIG. 2.

Two valve slots 39 are formed on the valve sleeve inner portion **37*a*. Valve slots 39, as shown in FIG. 3, are spaced apart 180 degrees from each other. Each slot 39 extends circumferentially about 60 degrees. Each valve slot 39 extends from the junction of valve sleeve 37 with the valve body outer portion 35 inward to the inner end of the valve sleeve 37**.

Valve sleeve 37 has a bore 41 that is cylindrical and extends completely through it, with open inner and outer ends. The exterior of valve sleeve 37 on the outer portion 37*b* is cylindrical. A plurality of ridges or grooves 43 are formed on the exterior of the outer portion 37*b*. Ridges 43 are circumferential and axially spaced apart from each other.

A valve stem 45 rotatably mounts inside the valve sleeve 37. Valve stem 45 is tubular, having an axially extending bore 46. Valve stem 45 has an inner portion 47 that extends into the valve sleeve inner portion 37*a*. The inner portion 47 has a closed end 49 that terminates flush with the inner end of the valve sleeve 37.

Two stem slots 51 are formed in the valve stem inner portion 47. Stem slots 51 are located on the sidewall of the inner portion 47 and are spaced apart 180 degrees from each other, as shown in FIG. 3. The stem slots 51 also extend about 60 degrees. In FIG. 2, the stem slots 51 are shown aligned with the valve slots 39. In FIG. 3, the stem slots 51 are shown rotated out of alignment entirely with the valve slots 39.

When the stem slots 51 are aligned with the valve slots 39, fluid will flow through the slots 39, 51 and into the bore 46 of the valve stem 45. When out of alignment, as shown in FIG. 3, the closed end 49 and the misalignment of the slots 39, 51, will prevent flow from the interior of handle 13 into the bore 46. Slight overlap or alignment will provide for some flow, but it will restrict the flow depending on the amount of alignment of the slots 39, 51.

Valve stem 45 has an outer portion 53 that protrudes outward from the valve sleeve outer portion 37*b*. The valve stem outer portion 53 has a plurality of circumferentially extending ridges 55. Ridges 55 are axially spaced apart from each other.

Figure 4:
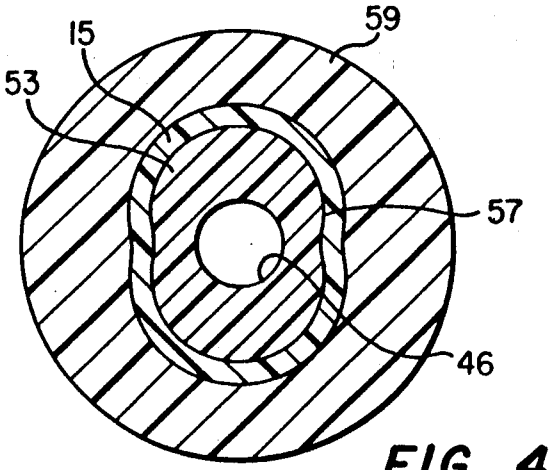
FIG. 4 is a sectional view of portions of the handle of FIG. 2, taken along the line IV—IV of FIG. 2.

Referring to FIG. 4, the valve stem outer portion 53 has two flattened areas 57 located 180 degrees apart from each other. These flattened areas in cross section are substantially flat and give a generally elliptical configuration to the valve stem outer portion 53. The flattened areas are separated by two areas that are curved and having a common radius.

The conduit 15 will slide frictionally over the valve stem outer portion 53. Being flexible, the end of conduit 15 will assume the elliptical configuration shown in FIG. 4. Conduit 15 also extends over the exterior of the valve sleeve outer portion 37*b*. The valve sleeve outer portion 37*b* is cylindrical, however, allowing the end of the conduit 15 to rotate relative to the valve sleeve outer portion 37*b*. The flattened areas 57 prevent the end of conduit 15 from rotating relative to the valve stem 45.

A collar 59 slides over the end of the conduit 15. Collar 59 has an inner opening 61 that locates around the valve stem outer portion 53. The inner opening 61 has the same general elliptical configuration as the valve stem outer portion 53. Inner opening 61 has two flattened areas. Inner opening 61 is slightly larger, resulting in a clearance for receiving the conduit 15. The collar 59 forces the end of the conduit 15 to assume the general elliptical configuration shown in FIG. 4.

Collar 59 has a lip 63 that extends back over the valve body outer portion 35. Lip 63 extends to the shoulder 36, enclosing the valve body outer portion 35. Lip 63 has two recesses 65, shown also in FIG. 1. Recesses 65 are located 180 degrees from each other. One of the recesses 65 will align with one of the numerals of the indicia 19 (FIG. 1). The recesses 65 serve as part of the indicia means for indicating the amount of rotation of the collar 59 relative to the valve body outer portion 35. This indicates the amount of alignment of the slots 39 and 51 with each other. The flattened areas 57 assure that the collar 59 will locate only in one of two positions relative to the valve stem outer portion 53, each position being 180 degrees from the other. This assures that the recess 65 corresponds to the correct indicia number 19 for the alignment of the slots 39 and 51.

To assemble the exercise apparatus 11, the valve body 25 is placed inside the open end 23 of handle 13. Compression sleeve 33 then will be moved in place to secure the handle 13 to the valve body 25. The assembly of handle 13 is filled with water. The valve stem 45 is inserted into the end of the conduit 15. The collar 59 is inserted over the valve stem outer portion 53. The end of the conduit 59 is inserted over the valve sleeve outer portion 37*b*. The collar 59 will locate with its lip 63 over one numeral of the indicia 19.

In operation, the user alternately squeezes the handles 13. When squeezing one handle 13, liquid will flow through the slots 39, 51, and out bore 46 into the conduit 15. Fluid will flow in the conduit 15 toward the other handle 13. The ball 17 will move along with the fluid flow. In the other handle 13, the fluid will flow through the bore 46 and through the slots 51 and 39 into the interior of handle 13.

If the user wishes to change the amount of resistance, he will rotate the collar 59 relative to the handle 13. This rotation causes the valve stem 45 to rotate relative to the valve sleeve 37. The end of conduit 15 will rotate on the exterior of the valve sleeve outer portion 37*b*. If rotated in one direction, the alignment of the slots 39, 51 will decrease. This restricts the flow area and increases the resistance. If rotated in the other direction, the alignment of the slots 39, 51 increases, increasing the flow area of the slots 39, 51. The indicia 19 (FIG. 1) indicate the relative amount of resistance that the user selects.

The resistance to flow occurs in the handle 13 being squeezed as a result of the alignment of the slots 39, 51 in the squeezed handle 13. The particular resistance setting of the handle 13 receiving the fluid flow does not noticeably affect the resistance of the handle 13 being squeezed because the volume of the handles 13 and conduit 15 exceeds the volume of the fluid placed in the handles 13 and conduit 15. The particular resistance setting on one handle 13 does not have to match the particular resistance setting on the other handle 13.

The invention has significant advantages. It provides effective exercise for the hands. The resistance can be varied. The device is portable and simple in construction.

While the invention has been shown in only one of its forms, it should be apparent to those skilled in the art that it is not so limited, but is susceptible to various changes without departing from the scope of the invention.

I claim:

1. A method of exercising hands, comprising:

providing a pair of flexible hollow handles;

mounting a valve body to each of the handles;

providing each of the valve bodies with a valve sleeve extending inward, and providing each of the valve sleeves with a side wall containing a sleeve slot;

positioning a tubular valve stem in each of the valve sleeves, and providing each of the valve stems with a side wall containing a stem slot;

mounting a conduit to each valve stem, interconnecting the valve stems with each other;

placing a substantially incompressible fluid in the handles and conduit;

rotating each of the valve stems relative to each of the valve bodies to selectively align each of the stem slots with one of the sleeve slots;

grasping with a hand each of the handles; then squeezing one of the handles, causing fluid to displace from the handle being squeezed out through one of the sleeve slots and stem slots into the conduit, and causing fluid in the conduit to flow through the other of the sleeve slots and stem slots and into the other of the handles, the degree of alignment of each of the stem slot with the sleeve slot of the handle being squeezed determining the resistance to flow of the fluid.

2. A hand exercising apparatus, comprising in combination:

a pair of flexible hollow handles, each having a closed end and an open end;

a valve body mounted to the open end of each of the handles;

each of the valve bodies having a valve sleeve extending inward, each of the valve sleeves having a side wall containing a sleeve slot;

a tubular valve stem carried in each of the valve sleeves and protruding outward therefrom, each of the valve stems having a side wall containing a stem slot, each of the valve stems being manually rotatable relative to the valve bodies so as to selectively align each of the stem slots with one of the sleeve slots;

a conduit mounted to each valve stem, interconnecting the valve stems with each other; and the handles and conduit containing a fluid such that alternately squeezing the handles causes fluid to displace from one handle out through one of the sleeve slots and stem slots into the conduit, and causing fluid in the conduit to flow through the other of the sleeve slots and stem slots and into the other of the handles, the degree of alignment of the stem slots with the sleeve slots of the handle being squeezed determining the resistance to flow of the fluid.

3. The apparatus according to claim 2, further comprising:

a collar rigidly mounted over each of the valve stems for grasping by a user to facilitate rotation of each of the valve stems relative to each of the valve bodies.

4. The apparatus according to claim 2 wherein the conduit mounts to each of the valve stems for rotation with each of the valve stems.

5. The apparatus according to claim 2 wherein each of the valve sleeves has an open inner end in communication with the interior of one of the handles, and wherein each of the valve stems has a closed inner end which locates in the inner end of one of the valve sleeves and blocks flow of fluid through the inner end of the valve sleeves, requiring any flow of fluid to pass through the sleeve and stem slots.

6. The apparatus according to claim 2 wherein there are two of the sleeve slots in each of the valve sleeves, each spaced circumferentially apart from each other, and wherein there are two of the stem slots in each of the valve stems, each spaced circumferentially apart from each other.

7. A hand exercising apparatus, comprising in combination:

a pair of flexible hollow handles, each having a closed end and an open end;

a valve body mounted in the open end of each of the handles;

each of the valve bodies having a valve sleeve extending inward, each of the valve sleeves having a side wall containing a sleeve slot;

a tubular valve stem carried in each of the valve sleeves, each of the valve stems having an inner portion located in one of the valve sleeves and having a side wall containing a stem slot, each of the valve stems being manually rotatable relative to the valve bodies so as to selectively align each of the stem slots with one of the sleeve slots;

each of the valve stems having an outer portion protruding outward from one of the valve sleeves, the outer portion having an exterior;

a conduit having two ends, each of which slides over the outer portion of each of the valve stems, interconnecting the valve stems with each other;

a collar for each of the valve stems, each having an inner opening which has a contour that is the shape of the exterior of the valve stems and is larger by a clearance for sandwiching the ends of the conduit between the exterior of the valve stems and the collars to sealingly retain the conduit with the valve stems;

alignment means on the inner opening of each of the collars and the exterior of each of the valve stems for requiring that each of the collars locate on one of the valve stems in no more than two rotational positions relative to the valve stem, each position being 180 degrees apart from each other;

the handles and conduit containing a fluid such that alternately squeezing the handles causes fluid to displace from one handle out through one of the sleeve slots and stem slots into the conduit, and causes fluid in the conduit to flow through the other of the sleeve slots and stem slots and into the other of the handles, the degree of alignment of each of the stem slot with the sleeve slot of the handle being squeezed determining the resistance to flow of the fluid; and indicia means on the valve bodies and on the collars for indicating the degree of alignment of the sleeve and stem slots, the alignment means of the collars and valve stems assuring during assembly of the apparatus a correct correspondence between the indicia means and the sleeve and stem slots.

8. The apparatus according to claim 7 wherein each of the alignment means comprises:

at least one noncircular portion on the exterior of each of the valve stems and a mating shaped noncircular portion on the inner opening of each of the collars.

9. The apparatus according to claim 8 wherein each of the valve stems contains two of the noncircular portions.

10. The apparatus according to claim 7 wherein each of the valve bodies has an exterior wall protruding outward from the handle, and wherein each of the collars has an exterior wall that extends to the exterior wall of one of the valve bodies and wherein the indicia means comprises:

indicia on one of the exterior walls of the collars and valve bodies.

11. The apparatus according to claim 7 wherein each of the valve bodies has a conical surface over which the open end of one of the handles extends, the conical surface containing a plurality of circumferentially extending ridges for gripping the handle; and wherein the apparatus further comprises:

a compression sleeve which extends over the open end of each of the handles and sandwiches the open end of each of the handles between the compression sleeve and the conical surface of each of the valve bodies.

12. The apparatus according to claim 7, wherein the conduit is transparent, the apparatus further comprising:

a floating element received within the conduit, the element being visible from the exterior of the conduit to indicate the direction of fluid flow.

13. A hand exercising apparatus, comprising in combination:

a pair of flexible hollow handles, each having a closed end and an open end and containing a liquid;

a pair of valve bodies, each having an inner portion containing a plurality of circumferentially extending ridges, the open end of each of the handles sliding over the inner portions;

a compression sleeve sliding over the open ends of each of the handles and compressing the open ends of the handles between the inner portions of each of the valve bodies and the compression sleeve;

each of the valve bodies having a valve sleeve with an inner end extending into the handle, each of the valve sleeves having a side wall containing a sleeve slot;

a tubular valve stem carried in each of the valve sleeves, each of the valve stems having an inner portion located in one of the valve sleeves and having a side wall containing a stem slot, each of the valve stems being manually rotatable relative to the valve bodies so as to selectively align each of the stem slots with one of the sleeve slots;

closure means located inward of each of the sleeve and stem slots for requiring any of the liquid flowing into and out of each of the handles to flow through the sleeve and stem slots when aligned;

each of the valve stems having an outer portion protruding outward from one of the valve sleeves, the outer portion having an exterior containing a plurality of circumferentially extending ridges, the exterior of the outer portion having a noncircular contour when viewed in transverse cross section;

a transparent conduit having two ends, each of which slides over the outer portion of each of the valve stems, interconnecting the valve stems with each other;

a collar for each of the valve stems, each having an inner opening which has a contour that is the shape of the exterior of the valve stems and is larger by a clearance for sandwiching the ends of the conduit between the exterior of the valve stems and the collars to sealingly retain the conduit with the valve stems;

whereby alternately squeezing the handles causes liquid to displace from one handle out through one of the sleeve slots and stem slots into the conduit, and causes liquid in the conduit to flow through the other of the sleeve slots and stem slots and into the other of the handles, the degree of alignment of the stem slot with the sleeve slot of the handle being squeezed determining the resistance to flow of the liquid;

a floating element received within the conduit, the element being visible from the exterior of the conduit to indicate the direction of fluid flow; and indicia means on the valve bodies and on the collars for indicating the degree of alignment of the sleeve and stem slots, the noncircular exterior of the valve stems assuring during assembly of the apparatus a correct correspondence between the indicia means and the sleeve and stem slots.

14. The apparatus according to claim 13, wherein the noncircular exteriors of the valve stems each have two circular portions interconnected by two flattened portions.

* * * * *